US007789927B2

(12) United States Patent
Tramontina et al.

(10) Patent No.: US 7,789,927 B2
(45) Date of Patent: Sep. 7, 2010

(54) PORTABLE BREATHABLE DUST PARTITION SYSTEM

(75) Inventors: Paul F. Tramontina, Harleysville, PA (US); Richard P. Lewis, Marietta, GA (US); Jeffrey J. Krueger, Roswell, GA (US); Charles H. Goerg, Alpharetta, GA (US); Frances W. Mayfield, Marietta, GA (US); Ann L. McCormack, Cumming, GA (US); Jacqueline B. Martin, Buford, GA (US); David Lilley, Duluth, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 362 days.

(21) Appl. No.: 11/774,014

(22) Filed: Jul. 6, 2007

(65) Prior Publication Data

US 2009/0007529 A1 Jan. 8, 2009

(51) Int. Cl.
*B01D 46/00* (2006.01)
*E06B 9/00* (2006.01)

(52) U.S. Cl. ..... 55/491; 55/358; 55/490; 55/493; 55/495; 160/351; 160/368.1; 160/380

(58) Field of Classification Search ..... 55/356, 55/358, 490, 491, 493, 495, 496, 527, 528; 160/351, 368.1, 380
See application file for complete search history.

(56) References Cited

U.S. PATENT DOCUMENTS 3,338,992 A 8/1967 Kinney
3,341,394 A 9/1967 Kinney
3,480,069 A 11/1969 Handwerker
3,485,706 A 12/1969 Evans
3,502,763 A 3/1970 Hartmann
3,542,615 A 11/1970 Dobo et al.
3,692,618 A 9/1972 Dorschner et al.
3,802,817 A 4/1974 Matsuki et al.
3,849,241 A 11/1974 Butin et al.
4,041,203 A 8/1977 Brock et al.
4,215,682 A 8/1980 Kubik et al.
4,340,563 A 7/1982 Appel et al.

(Continued)

FOREIGN PATENT DOCUMENTS

DE 3918516 12/1990

(Continued)

OTHER PUBLICATIONS

PCT Search Report, Oct. 30, 2008.

(Continued)

*Primary Examiner*—Michael A Marcheschi
*Assistant Examiner*—Robert A Clemente
(74) *Attorney, Agent, or Firm*—Dority & Manning, P.A.

(57) ABSTRACT

A portable partition system includes an air permeable non-woven sheet material as the primary isolation material. An elongated support member with an attachment device are used to erect the sheet material. The attachment device includes a head with opposed separable clamping surfaces having a hook material provided thereon. The sheet material is inserted between the clamping surfaces so as to be engaged directly by the hook material on opposite sides of the sheet material upon erecting the system into a portable partition.

23 Claims, 5 Drawing Sheets

U.S. PATENT DOCUMENTS

| | | | | |
|---|---|---|---|---|
| 4,375,718 | A | 3/1983 | Wadsworth | |
| RE31,733 | E | 11/1984 | Haworth et al. | |
| 4,493,174 | A * | 1/1985 | Arens | 52/243 |
| 4,592,815 | A | 6/1986 | Nakao | |
| 4,663,220 | A | 5/1987 | Wisneski et al. | |
| 4,708,189 | A | 11/1987 | Ward | |
| 4,794,974 | A | 1/1989 | Melino | |
| 4,874,659 | A | 10/1989 | Ando et al. | |
| 5,038,889 | A | 8/1991 | Jankowski | |
| 5,158,127 | A | 10/1992 | Schumacher | |
| 5,169,706 | A | 12/1992 | Collier, IV et al. | |
| 5,188,885 | A | 2/1993 | Timmons et al. | |
| 5,345,989 | A | 9/1994 | Brophy | |
| 5,350,444 | A * | 9/1994 | Gould et al. | 96/154 |
| 5,389,202 | A | 2/1995 | Everhart et al. | |
| 5,401,446 | A | 3/1995 | Tsai et al. | |
| 5,486,411 | A * | 1/1996 | Hassenboehler et al. | 442/328 |
| 5,524,693 | A | 6/1996 | Hamilton | |
| 5,537,795 | A | 7/1996 | Dias | |
| 5,613,543 | A | 3/1997 | Walton | |
| 5,896,718 | A | 4/1999 | Westgarth | |
| 5,924,469 | A | 7/1999 | Whittemore | |
| 5,964,742 | A | 10/1999 | McCormack et al. | |
| 6,086,128 | A | 7/2000 | Whitehead, Sr. | |
| 6,123,321 | A | 9/2000 | Miller | |
| 6,152,434 | A | 11/2000 | Gluck | |
| 6,209,615 | B1 | 4/2001 | Whittemore | |
| 6,321,823 | B1 | 11/2001 | Whittemore | |
| 6,365,088 | B1 | 4/2002 | Knight et al. | |
| 6,508,295 | B2 * | 1/2003 | Whittemore | 160/368.1 |
| 6,573,205 | B1 | 6/2003 | Myers et al. | |
| 6,772,458 | B2 | 8/2004 | Ellen et al. | |
| 6,865,850 | B1 | 3/2005 | Campbell | |
| 6,942,004 | B2 * | 9/2005 | Whittemore | 160/368.1 |
| 6,953,076 | B2 * | 10/2005 | Whittemore | 160/368.1 |
| 7,097,891 | B2 | 8/2006 | Fenelon | |
| 7,108,040 | B2 | 9/2006 | Whittemore | |
| 7,261,140 | B2 * | 8/2007 | Whittemore | 160/368.1 |
| 7,503,373 | B2 * | 3/2009 | Whittemore | 160/368.1 |
| 7,533,712 | B2 * | 5/2009 | Whittemore et al. | 160/368.1 |
| 2002/0043349 | A1 | 4/2002 | Rigby et al. | |
| 2005/0077015 | A1 | 4/2005 | Melino, Jr. et al. | |
| 2005/0109470 | A1 | 5/2005 | Fruedenberg et al. | |
| 2005/0247414 | A1 | 11/2005 | Whittemore | |
| 2006/0272785 | A1 | 12/2006 | Whittemore | |
| 2006/0283562 | A1 | 12/2006 | Hickey | |
| 2007/0125700 | A1 * | 6/2007 | Ding et al. | 210/490 |

FOREIGN PATENT DOCUMENTS

| | | |
|---|---|---|
| GB | 2 412 137 | 9/2005 |
| JP | 2000-274160 | 10/2000 |
| WO | WO 94/27480 | 12/1994 |
| WO | WO 02/27122 | 4/2002 |
| WO | WO 2005/103380 | 11/2005 |
| WO | WO 2006/017684 | 2/2006 |
| WO | WO 2006/041418 | 4/2006 |

OTHER PUBLICATIONS

*Encyclopedia of Polymer Science and Engineering*, "Telechelic Polymers," vol. 16, 1989, pp. 494-554.

* cited by examiner

PORTABLE BREATHABLE DUST PARTITION SYSTEM

TECHNICAL FIELD OF THE INVENTION

The present invention relates generally to the field of portable partition systems or devices, and more particularly to a partition system that utilizes a breathable, nonwoven filtration material.

BACKGROUND

Control of dust and other airborne particulate material is a major issue in building construction and renovation projects, particularly when other sections of the building or structure are inhabited or otherwise used and must remain free of such airborne particulates. The adverse affects of high concentrations of airborne dust and other particulates on personnel are well known, and must be minimized. Electronic operating equipment (e.g., computer terminals, electronic control systems, HVAC systems, and the like) are also adversely affected by high levels of airborne particulates and must be protected from excess exposure to dust and other matter generated from construction and remodeling projects.

Current methods of dust and particulate control involve erecting portable partitions to isolate the areas where dust is being produced. These partitions generally use any manner of portable scaffolding, poles, or other structure for supporting plastic sheeting or other generally impermeable sheeting materials between the floor and ceiling to isolate the "dirty" area. The conventional sheeting materials are, however, problematic in certain respects. For example, plastic sheeting materials are non-porous and do not allow air to circulate into the partitioned-off areas. These areas eventually become hot and humid, and the odors generated from the construction materials also become essentially trapped in the enclosure. This results in a less than optimal environment for personnel that must work within the partitioned area. Also, the plastic sheeting material does not capture the airborne particulates, which tend to accumulate on the floor of the partitioned area where they are repeatedly "stirred-up" or agitated into subsequent airborne matter.

The support structure for the plastic or other heavy, non-porous sheet materials must also be designed to handle and support the relatively heavy materials over long periods of time.

Various patent references describe portable partition systems. For example, U.S. Pat. Nos. 5,924,469; 6,321,823; and 7,108,040 to Whittemore describe various structural support devices intended to support "curtains" of flexible sheet material defined to include cloth sheets, drapes, and plastic tarps. U.S. Pat. No. 6,123,321 describes a modular system that includes a rigid frame for supporting flexible plastic sheet material that stretched over and secured to the frame. U.S. Pat. App. Pub. No. 2005/0077015 describes a telescoping pole system having a clamping device at an end thereof for retaining plastic or other sheet material in a temporary partition.

A need still exists for improved temporary, portable partitions that offer distinct advantages over the current available systems.

SUMMARY

Objects and advantages of the invention will be set forth in the following description, or may be obvious from the description, or may be learned through practice of the invention.

A portable partition system is provided that utilizes an air permeable nonwoven sheet material as the primary barrier material. This material may be, for example, a spunbond/meltblown/spunbond (SMS) laminate material having a desired degree of air permeability and filtration properties. As recognized by those skilled in the art, the desired nonwoven material may be selected based on any combination of material properties, such as basis weight, permeability, strength, and so forth. Air permeability and filtration are important properties in that they allow air to circulate into and out of the partitioned area while ensuring the desired degree of dust and other airborne particulate filtration. Nonwoven materials, such as conventional SMS materials, also serve to capture and retain the airborne particulates within the material structure, thus preventing to at least some degree the particulate matter from accumulating and being recirculated within the partitioned area.

In a particular embodiment, the nonwoven material may be an electret material produced from any know electret treating process to enhance the filtration and particle retaining properties of the material.

In other embodiments, the nonwoven material may contain an odor control agent, such as activated carbon or titanium dioxide, to reduce noxious odors generated within the enclosed area as air is drawn from or into the enclosed area. This agent may be in the form of particles that are adhered or otherwise captured within the nonwoven material.

Another problem addressed by the use of a breathable nonwoven partition is the pressure differential that can be generated within a room on opposite sides of a non-breathable (air impermeable) material, such as the plastic sheeting material commonly used for such partitions. For example, with the non-breathable materials, the opening or closing of a door or activation of the HVAC system results in the sheeting being sucked or pushed in different directions as a result of pressure differentials created within the room. This results in increased agitation of the accumulated particulate matter or dust within the enclosed area, as well as annoying noises generated by the moving sheet material. With the breathable nonwoven material, the pressure differential across the material is significantly reduced, and such problems are minimized.

An elongated support member is provided as a component of the overall system and serves to provide a means for erecting the nonwoven material. This support member may include any one or combination of structural members, such as poles, rods, scaffolding, and the like. The support members may have a fixed length, or may be adjustable in length. For example, any manner of known telescoping poles or rods may be utilized. The support member may comprises a plurality of members that are attached or linked together to provide a frame structure.

An attachment device having a body is configured on a first end of the support member and defines the attachment location for the nonwoven material. The attachment device may take on various shapes and configurations, and may include a head having opposed separable clamping surfaces between which the nonwoven material is inserted so that the material is sandwiched between the clamping surfaces. In an alternate embodiment, the head may have a single clamping surface such that the sheet material is held between the clamping surface and a wall or ceiling surface of the enclosed area. The clamping surfaces have a hook material provided thereon that directly engages and attaches to the nonwoven material so that the material is engaged by the hooks on at least one side. In the embodiment using dual clamping surfaces, the sheet material is engaged by hook material on both sides. The hook material may be considered as any conventional hook component of a hook-and-loop attachment device, as is commonly known and understood in the art. The hooks may be molded directly into the surface of the clamping surfaces, or may be defined by a separate material that is adhered or otherwise attached to the clamping surfaces.

A property of nonwoven materials is that they can also function as a loop material that is directly engaged by hook material in a hook-and loop attachment mechanism, thus avoiding the need for a separate loop material landing pad or zone. The nonwoven material can thus be continuously readjusted, stretched, or otherwise manipulated without concern of aligning or positioning a limited area loop pad or zone on the material relative to the attachment device.

To aid in erecting the system, it may be desired to incorporate one or more compression devices in the attachment device or elongated support member. This compression device may be, for example, a spring loaded component that is compressed in order to allow the support member to be positioned in a desired location relative to a wall or ceiling, with the device subsequently releasing and expanding to engage against the wall or ceiling. The compression device may be a mechanical spring arrangement, or a pneumatic or hydraulic device. The device may be incorporated within the body of the attachment device, or as a component of the elongated support member.

The attachment device may be a fixed non-removable component relative to the elongated support member, or may be a separate component that is easily and removably attached to the elongated support member, for example with a threaded or friction-fit connection.

The head member of the attachment device may be fixed relative to the body, or may be pivotable relative to an axis of body or elongated support member to aid in attaching the nonwoven sheet material and subsequent erecting of the system. With the pivotal embodiment, a mechanism may be provided to lock the head in position. For example, a sleeve member may be configured around the body of the attachment device and slidable to engage and lock the pivotable head in position relative to the body. Any manner of locking mechanism may be used in this regard.

The clamping surfaces in the attachment device may take on various configurations. In a particular embodiment, the head includes a bottom plate and a top plate hinged to the bottom plate, with the clamping surfaces defined by the opposed facing surfaces of the top and bottom plates. The plates may be spring biased to a closed position. In an alternate embodiment, the head includes a bottom plate and a top plate that is completely separable from the bottom plate, with the clamping surfaces defined by opposed facing surfaces of the top and bottom plates. Any manner of releasable locking mechanism may be configured between the separate top and bottom plates.

In the embodiment of a single clamping surface, the top surface of a single plate member may contain the hook material, with the sheet material being sandwiched between this plate and the wall or ceiling surface of the enclosed area.

In a unique embodiment, the elongated support member may include a plurality of interlocking members that are slidable relative to each other so as to be variably extended to a desired length. The members may include interlocking channel structures that prevent the members from separating, yet allow the members to slide in a longitudinal direction. A lockable adjustment mechanism may be configured between the interlocked members. For example, in a particular embodiment, the adjustment mechanism may include a rack and pinion gear mechanism.

The present invention also encompasses an attachment device as described herein that may be attached to an elongated support member in a portable partition system for erecting a nonwoven sheet material barrier.

Further aspects of embodiments of the invention are described below by reference to particular illustrated embodiments.

BRIEF DESCRIPTION OF THE DRAWINGS

A full and enabling description of the present subject matter, including the best mode thereof, directed to one of ordinary skill in the art, is set forth in the specification, which makes reference to the appended figures, in which.

Figure 1:
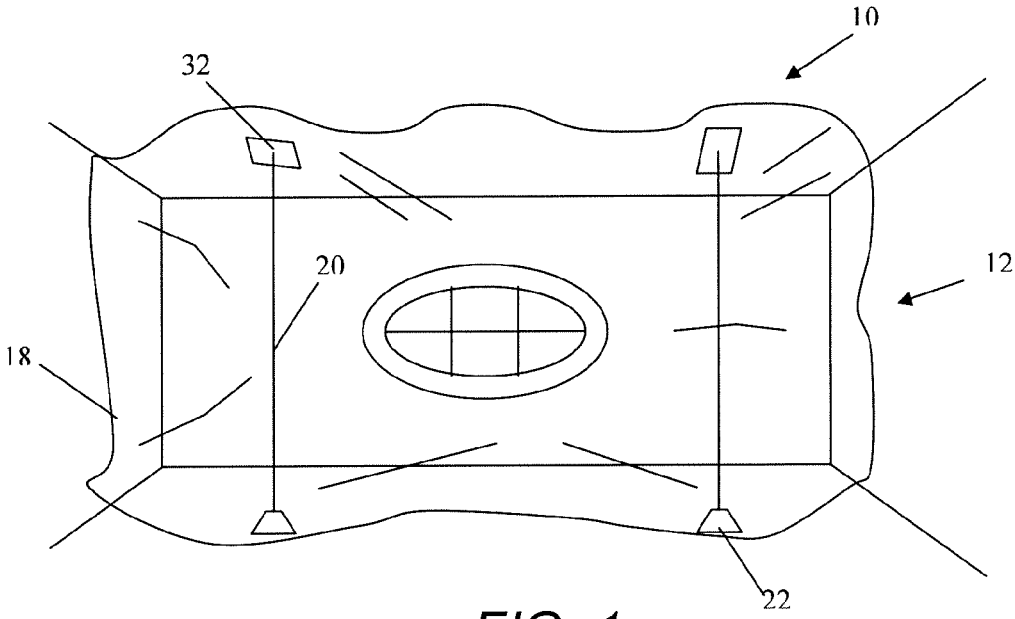
FIG. 1 is a partial perspective view of an embodiment of a portable dust partition system in accordance with the invention.

Repeat use of reference characters throughout the present specification and appended drawings is intended to represent the same or analogous features or elements of the present technology.

DETAILED DESCRIPTION

Reference will now be made in detail to one or more embodiments of the invention, examples of which are graphically illustrated in the drawings. Each example and embodiment is provided by way of explanation of the invention, and not meant as a limitation of the invention. For example, features illustrated or described as part of one embodiment may be utilized with another embodiment to yield still a further embodiment. It is intended that the present invention include these and other modifications and variations.

As used herein, the terms "electret" refers to a treatment that imparts charges to a dielectric material, for example an olefin polymer. The charge includes layers of positive or negative charges trapped at or near the surface of the polymer, or charge clouds stored in the bulk of the polymer. The charge also includes polarization charges which are frozen in alignment of the dipoles of the molecules. Methods of subjecting a material to electreting are known by those skilled in the art. These methods include, for example, thermal, liquid-contact, electron beam and corona discharge methods. One particular technique of subjecting a material to electrostatic electreting is the technique disclosed in U.S. Pat. No. 5,401,466, the entire contents of which is hereby incorporated herein by reference. This technique involves subjecting a material to a pair of electrical fields wherein the electrical fields have opposite polarities. A process of forming an electret nonwoven web using a DC corona discharge is disclosed in U.S.

Pat. No. 6,365,088, the entire contents of which is also hereby incorporated herein by reference.

The term "ferroelectric material" is used herein to mean a crystalline material that possesses a spontaneous polarization which may be reoriented by the application of an external electric field. The term includes any phase or combination of phases exhibiting a spontaneous polarization, the magnitude and orientation of which can be altered as a function of temperature and externally applied electric fields. The term also is meant to include a single ferroelectric material and mixtures of two or more ferroelectric materials of the same class or of different classes. The term further includes a "doped" ferroelectric material, i.e., a ferroelectric material that contains minor amounts of elemental constituents, as well as solid solutions of such constituents, in the host ferroelectric material. Ferroelectric materials exhibit a "Curie point" or "Curie temperature" which refers to a critical temperature above which the spontaneous polarization vanishes. The Curie temperature often is indicated herein as "$T_c$".

As used herein, "telomer" includes a polymer having one or more functional groups located at the chain ends of the polymer. Telomers are also referred to as telechelic polymers and are known in the art. Various telomers and methods of making the same are described in Encyclopedia of Polymer Science and Engineering, vol. 16, pg. 494-554 (1989). As particular examples, polyolefin-anhydride telomers (a polyolefin polymer having one or more anhydride end groups) suitable for use with the present invention are commercially available from Exxon Chemical Company of Houston, Tex. under the tradename EXXELOR and from Uniroyal Chemical Company under the tradename POLYBOND. The telomer can be a homopolymer, copolymer, terpolymer or other composition. However, with copolymers or other polymers with a plurality of repeat units, the terminal or end functional groups of telomers do not have the same chemical functionality as the repeat units. Telomers can have either one or a plurality of functional end groups and the average number of functional end groups for a given telomer will vary with the method of formation, degree of chain branching and other factors known to those skilled in the art.

As used herein the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Buntin. Meltblown fibers are microfibers which may be continuous or discontinuous, are generally smaller than 10 microns in average diameter (using a sample size of at least 10), and are generally tacky when deposited onto a collecting surface.

As used herein the terms "nonwoven material" and nonwoven web" mean a web having a structure of individual fibers or threads which are interlaid, but not in an identifiable manner as in a knitted fabric. Nonwoven fabrics or webs have been formed from many processes such as, for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein the terms "spunbonded fibers" and "spunbond fibers" refer to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (using a sample size of at least 10) larger than 7 microns, more particularly, between about 10 and 25 microns.

As used herein, the term "thermal point bonding" involves passing materials (fibers, webs, films, etc.) to be bonded, for example, between a heated pattern roll and an anvil roll, a pattern roll and a flat anvil roll or two patterned rolls. The pattern roll is usually patterned in some way so that the entire fabric is not bonded across its entire surface. As a result, various patterns for calender rolls have been developed for functional as well as aesthetic reasons. Typically, the percent bonding area varies from around 10 percent to around 30 percent of the area of the fabric laminate. As is well known in the art, thermal point bonding holds the laminate layers together and imparts integrity to each individual layer by bonding filaments and/or fibers within each layer.

As used herein, the term "odor control agent" includes any substance known to reduce or mask odors. Examples of such materials include but are not limited to odor absorbents, activated carbon fibers and particles, baby powder, baking soda, chelating agents, zeolites, perfumes or other odor-masking agents, cyclodextrin compounds, oxidizers, and the like.

Spunbond/meltblown/spunbond (SMS) laminates are known and are described in greater detail in and U.S. Pat. No. 4,041,203 to Brock et al., U.S. Pat. No. 5,169,706 to Collier and in U.S. Pat. No. 5,188,885 to Timmons et al., the entire contents of which are hereby incorporated herein by reference. Generally, an SMS laminate is formed from one or more fibrous materials and includes a spunbonded layer, a meltblown layer, and a spunbonded layer formed from one or more thermoplastic polymers. SMS laminates may include other fibrous materials including natural fibers. The choice of fibers and thermoplastic polymer(s) depends upon, for example, fiber cost and the desired properties, e.g., liquid resistance, vapor permeability or liquid wicking, of the finished drape. For example, suitable thermoplastic resins may include, but are not limited to, synthetic resins such as those derived from polyolefins, polyesters, polyamides, polyacrylics, etc., alone or in combination with one another. Monocomponent and multicomponent, or conjugate, synthetic fibers may be used alone or in combination with other fibers. Other suitable fibers include natural fibers such as cotton, linen, jute, hemp, cotton, wool, wood pulp, etc. Similarly, regenerated cellulosic fibers such as viscose rayon and cuprammonium rayon, or modified cellulosic fibers, such as cellulose acetate, may likewise be used. Blends of one or more of the above fibers may also be used if so desired.

Suitable fiber forming polymers may have thermoplastic elastomers blended therein. In addition, the polymer components may contain additives for enhancing the crimpability and/or lowering the bonding temperature of the fibers, and enhancing the abrasion resistance, strength and softness of the resulting webs. For example, the low melting polymer component may contain about 5 percent by weight to about 20 percent by weight of a thermoplastic elastomer such as an ABA block copolymer of styrene, ethylenebutylene and styrene. Such copolymers are commercially available and some of which are identified in U.S. Pat. No. 4,663,220 to Wisneski et al. An example of highly suitable elastomeric block copolymers is KRATON G-2740. Another group of suitable additive polymers is ethylene alkyl acrylate copolymers, such as ethylene butyl acetate, ethylene methyl acrylate and ethylene ethyl acrylate, and the suitable amount to produce the desired properties is from about 2 weight percent to about 50 weight percent, based on the total weight of the low melting polymer component. Yet other suitable additive polymers include polybutylene copolymers and ethylene-propylene copolymers. In particular, SMS laminates that are formed from one or more polyolefin resins are especially suitable for filtration sheeting material. Desirably, the polyolefin resins are polypropylene or polyethylene resins. Most desirably, the polyolefin resins are polypropylene resins.

The sheet material of the present invention can be made from a variety of substrates in addition to the SMS laminate, including, but not limited to, woven fabrics, nonwoven fabrics, scrims, knit fabrics, and combination thereof. Desirably, the sheet material is formed from only one layer of bonded SMS nonwoven material. However, in the case of multiple layers, the SMS layer provides the filtration functionality. When multiple discrete layers are combined to form the sheet material, the layers are generally positioned in a juxtaposed or surface-to-surface relationship and all or a portion of the layers may be bound to adjacent layers.

The nonwoven sheet material used in the system of the present invention may include at least one SMS laminate that is electret treated. In this regard, the SMS laminate may include at least one layer a ferroelectric material and, more desirably, at least one layer that includes a ferroelectric material and further includes a telomer. More desirably, the material may comprise a SMS laminate that includes a ferroelectric material and a telomer in each layer. Specifically, in one desirable embodiment, the two spunbonded layers and the interior meltblown layer each include a ferroelectric material and a telomer. Desirably, the meltblown layer in the SMS laminate is an electret meltblown layer. The meltblown layer has a basis weight selected to achieve an overall breathability of the material at an acceptable level.

Electret treatment of the SMS laminate further increases filtration efficiency by drawing particles to be filtered toward the fibers of the filter by virtue of their electrical charge. Electret treatment can be carried out by a number of different techniques. An exemplary technique of electret treatment is described in U.S. Pat. No. 5,401,446 to Tsai et al. assigned to the University of Tennessee Research Corporation, the entire contents of which are hereby incorporated herein by reference. Tsai describes a process whereby a web or film is sequentially subjected to a series of electric fields such that adjacent electric fields have substantially opposite polarities with respect to each other. Thus, one side of the web or film is initially subjected to a positive charge while the other side of the web or film is initially subjected to a negative charge. Then, the first side of the web or film is subjected to a negative charge and the other side of the web or film is subjected to a positive charge. Such webs are produced with a relatively high charge density. The process maybe carried out by passing the web through a plurality of dispersed non-arcing electric fields like, for example, between a charging wire or bar and a charged roller at a certain gap, where the field and gap may be varied over a range depending on the charge desired in the web. The web may be charged at a range of about −30 kVDC/cm to 30 kVDC/cm or more particularly −10 kVDC/cm to 25 kVDC/cm and still more particularly −5 kVDC/cm to about 25 kVDC/cm. The gap may be about 0.25 inch (6.5 mm) to about 2 inches (51 mm) or more particularly about 0.5 to 1.5 inches (13 to 38 mm) or still more particularly about an inch (25.4 mm). Other methods of electret treatment are known in the art such as that described in U.S. Pat. Nos. 4,215,682 to Kubik et al, 4,375,718 to Wadsworth, 4,592,815 to Nakao and 4,874,659 to Ando. A method of inline electret treating a nonwoven web is described in U.S. Pat. No. 6,365,088 to Knight et al., the entire contents of which are hereby incorporated herein by reference.

The spunbonded layers and meltblown layer of the SMS laminate are desirably bonded, more desirably thermally point bonded. Desirably, the layers are bonded after the layers are formed and before the laminate is further processed. Thermal point bonding involves passing a fabric or web of fibers to be bonded, for example the SMS laminate, between, for example a heated pattern roll and an anvil roll. The pattern roll is usually, though not always, patterned in some way so that the entire fabric is not bonded across its entire surface.

Figure 3:
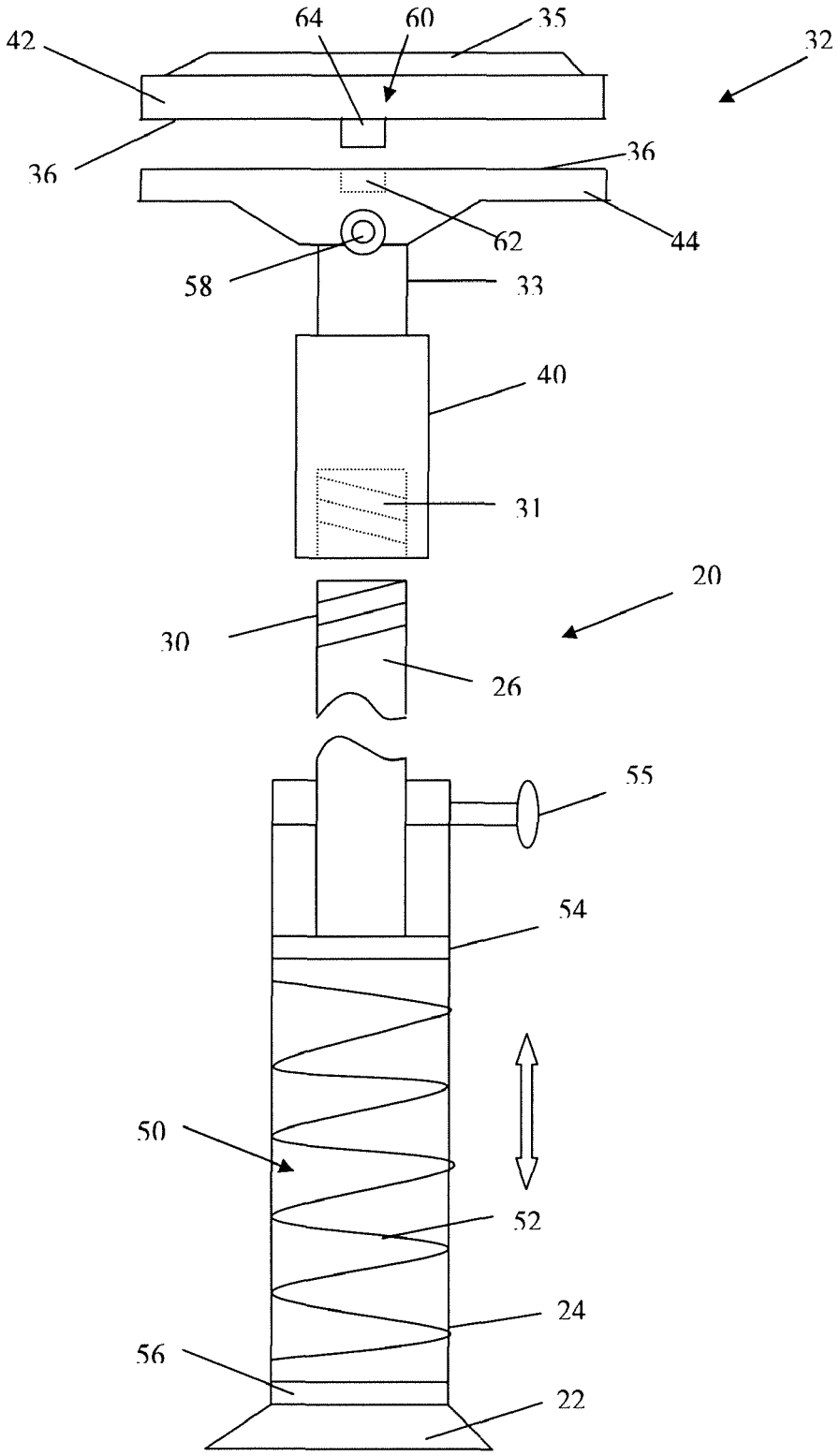
FIG. 3 is a side and partial cut-away view of an alternative embodiment of a support member and attachment for use in the portable partition system.

These bonding rolls can include a pattern roll and anvil roll in combination or two pattern rolls. As a result, various patterns for rolls have been developed for functional as well as aesthetic reasons. One example of a pattern known as a "wire weave" pattern is illustrated in FIG. 3 of U.S. Pat. No. 5,964,742 to McCormack et al. The wire weave pattern looks like a window screen and has about an 18 percent bond area. Other common patterns include a diamond pattern with repeating and slightly offset diamonds with about a 16% bond area. Typically, the percent bonding area varies from around 10% to around 30% of the area of the fabric laminate web. As is well known in the art, the spot bonding holds the laminate layers together as well as imparts integrity to each individual layer by bonding filaments and/or fibers within each layer.

FIG. 1 illustrates use of a portable partition system 10 used to isolate a section of a room 12 with a sheet material 18. In the illustrated embodiment, elongated support members 20 including footings 22 and attachment devices 32 are used to clamp the sheet material 18 to any combination of the ceiling, floor, or walls of the room 12. The support structures 20 and associated attachment devices 32 are described in greater detail below.

The sheet material 18 is a nonwoven web or sheet material and functions as the primary barrier material. As discussed above, this material may be an one or combination of known nonwoven materials. In a particular embodiment, the material 18 is an SMS laminate material having a desired degree of air permeability and filtration properties. The sheet material 18 may also be an electret material produced from any known electric treating process to enhance the filtration and particle retaining properties of the material 18. The sheet material 18 may contain any manner of odor control agents incorporated therein. The sheet material 18 is also compatible as a loop engagement surface with conventional hook materials in a hook and loop attachment mechanism wherein hook material in the attachment devices 32 directly engages and attaches to the non-woven sheet material 18. With this configuration, the non-woven sheet material 18 can be re-adjusted, stretched, or otherwise manipulated relative to the attachment devices 32 without the concern of having to align or position a loop pad or zone separately applied to the sheet material 18.

The elongated support members 20 provide a means for erecting the non-woven sheet material 18 at any desired location within a room 12 or other structure. The support members 20 may include any one or combination of structural members such as poles, rods, scaffolding, and the like. The support members 20 may have a fixed length or may be adjustable in length. For example, the elongated support members 20 may include any manner of known telescoping poles or rods, or may include a plurality of members that are attached or linked together to provide a framed structure.

Figure 2:
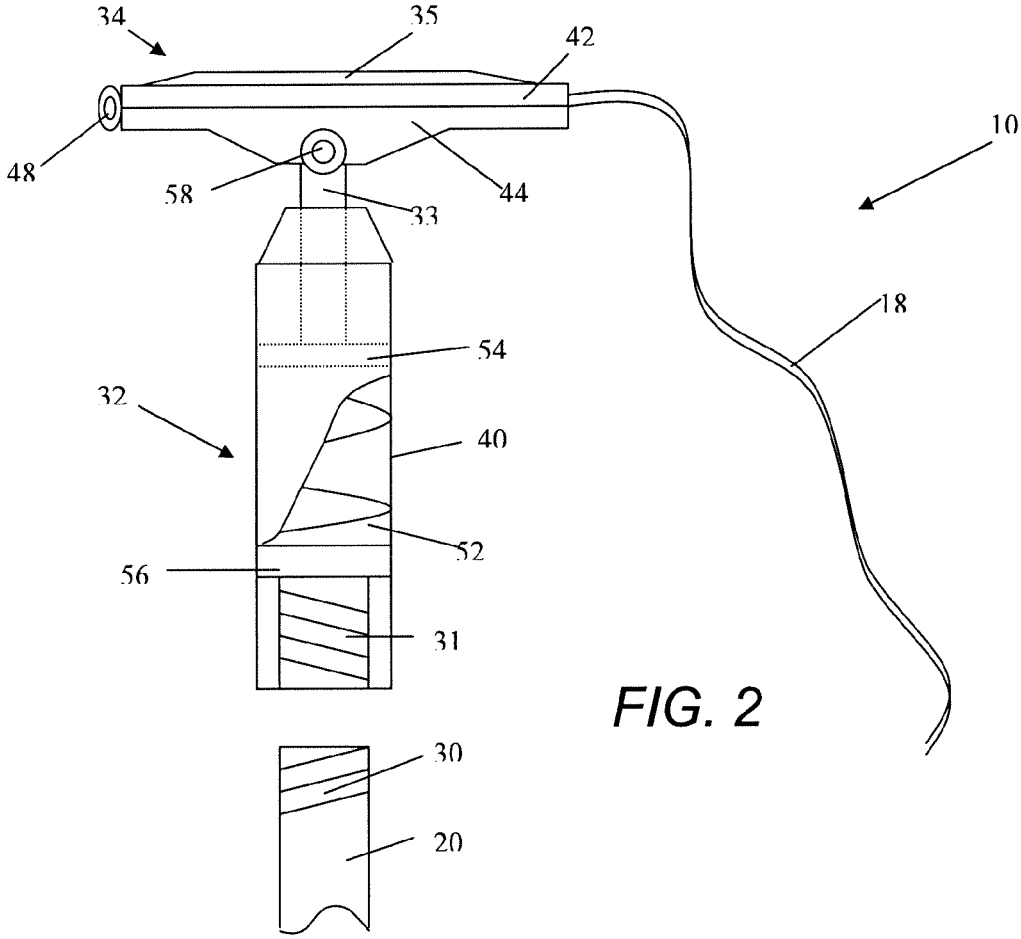
FIG. 2 is a side and partial cut-away view of an embodiment of a support member and attachment device for use in the partition system.

FIG. 2 illustrates an embodiment of the system 10 wherein the sheet material 18 is clamped in a head 34 of the attachment device 32 that is in turn attached to an end of the elongated support member 20. In the illustrated embodiment, the support member 20 includes a pole having threads 30 that engage with threads 31 at an end of a body member 40 of the attachment device 32. The body 40 may have any suitable shape and configuration, and serves primarily as an intermediate structure between the support member 20 and head 34.

Figure 4:
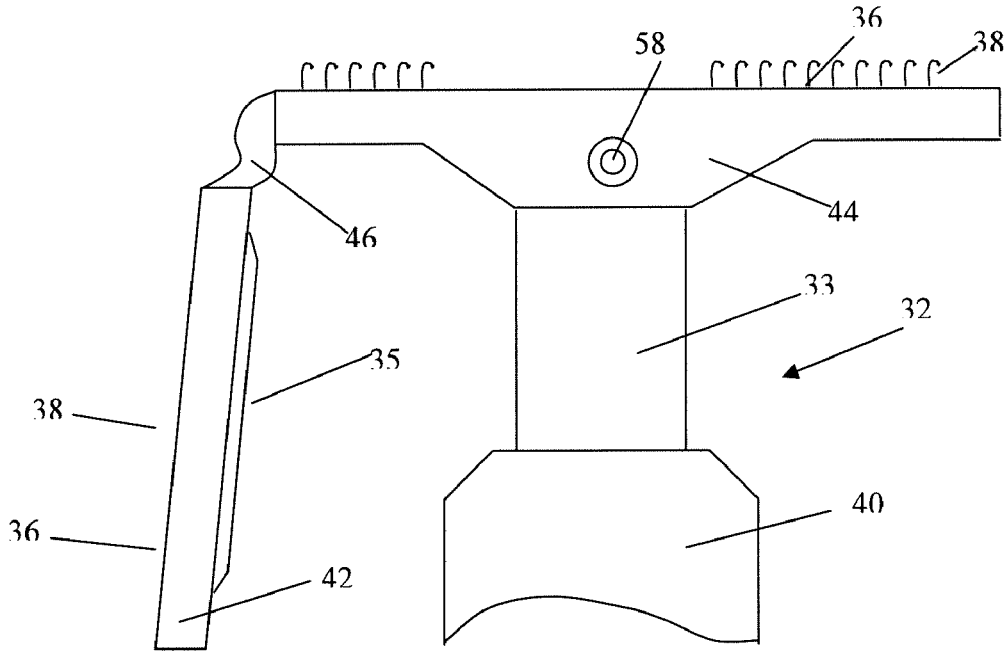
FIG. 4 is a side view of an alternative embodiment of an attachment for use with a support member.
Figure 5:
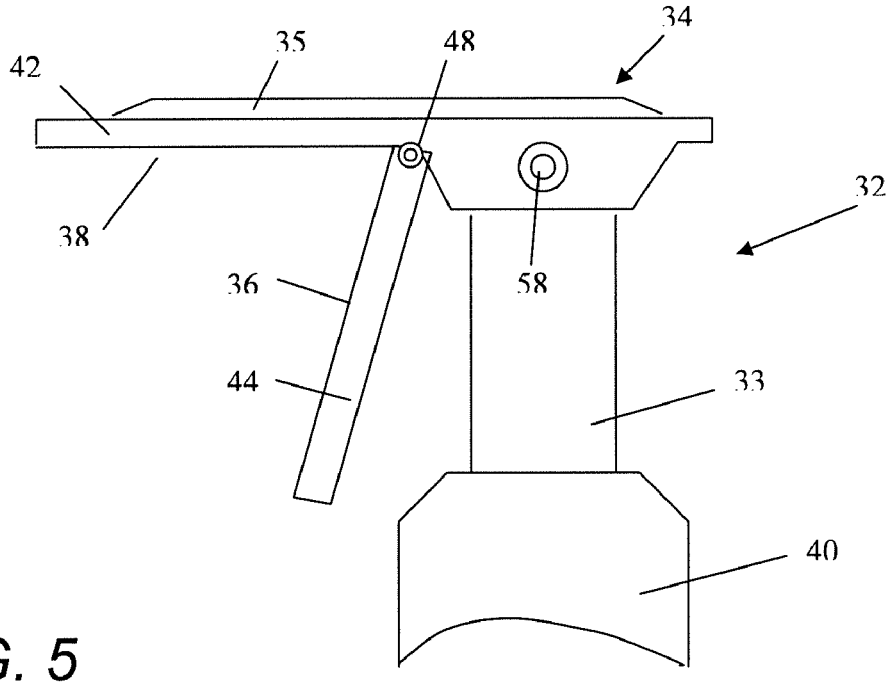
FIG. 5 is a side view of yet another alternative embodiment of an attachment device for use with a support member.

In the embodiment of FIGS. 2, 4, and 5, the head 34 of the attachment device 32 includes opposed, separable clamping surfaces between which the non-woven material 18 is inserted. In this manner, the non-woven material 18 is sandwiched between the clamping materials. In the illustrated embodiments, these clamping surfaces are defined by the opposed facing surfaces 36 of a bottom plate 44 and a top plate 42. The clamping surfaces 36 have a hook material 38 provided thereon that engages directly with the non-woven sheet material. The hook material 38 may be provided over the entire surface area of the clamping surfaces 36, or in a pattern such as stripes, grids, and so forth. The hook material 38 may be considered as any conventional hook component of a hook and loop attachment device, as is commonly known and understood in the art. One possible hook material 38 is a material having the mechanical characteristics of VELCRO 85-1215. The hook material 38 may be defined by individual hooks that are molded or otherwise formed directly into the exposed surface of the clamping surfaces 36. In an alternative embodiment, the hook material 38 may be provided by a separate material that is adhered or otherwise attached to the clamping surfaces 36, such as an adhesive backed hook material.

In particular embodiments, the top plate 42 and bottom plate 44 of the head 34 are hinged in a clam-shell configuration, as illustrated in FIGS. 2, 4, and 5. It may be further desired to include a spring 48 or other torsion member to bias the plates 42, 44 into a closed position. In use, an operator simply pulls the plates apart against the force of the spring 48, inserts the sheet material 18 between the plates, and then releases the plates.

In the embodiment of FIG. 4, a living hinge 46 is provided between the top plate 42 and bottom plate 44. This configuration may be beneficial for initial placement of the sheet material 18, particularly when a number of the attachment devices 32 and associated support members 20 are to be configured in the partition system. Although not illustrated in FIG. 4, it should be appreciated that any manner of mechanical latch or lock mechanism may serve to hold the top plate 42 against the bottom plate 44 after insertion of the sheet material 18.

Either of the top plate 42 or bottom plate 44 may be fixed relative to the body 40, with the other member being pivotal or releasable relative thereto. For example, in the embodiment of FIGS. 2, 4, and 7A, the top plate 42 is pivotal relative to the bottom plate 44. In the embodiment of FIG. 5, the bottom plate 44 is pivotal relative to the top plate 42 such that the sheet material 18 is inserted below the head 34.

Figure 6:
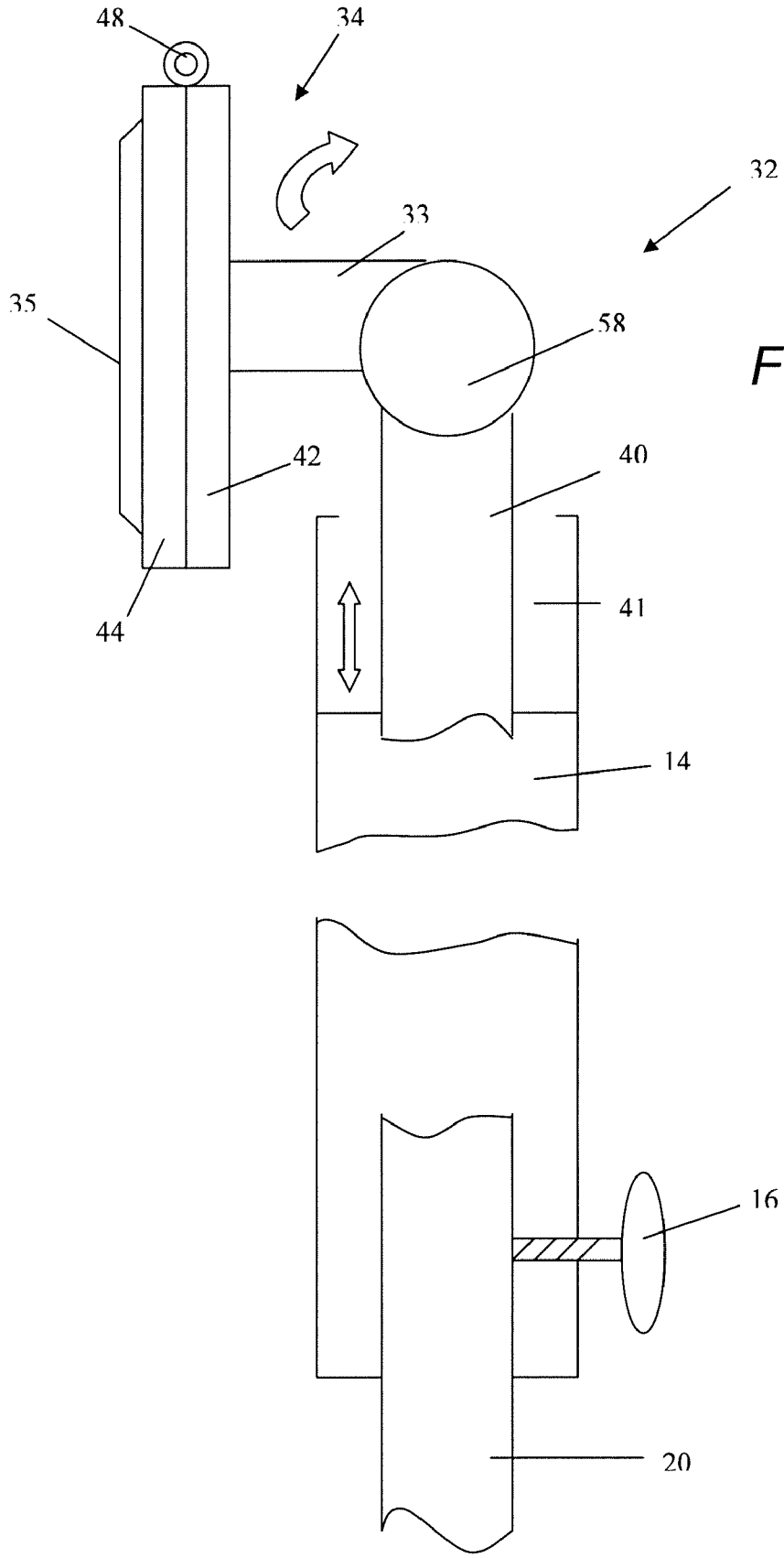
FIG. 6 is a side and partial cut-away view of an alternative attachment device and support member configuration.

The head 34 may be fixed relative to the body 40 of the attachment device 32, or may be pivotal relative to an axis of the body 40 or the elongated support member 20 to aid in positioning of the attachment devices 32 when erecting the system. For example, in FIGS. 2 through 5, and 7A, the head 34 is attached to the body member 40 with any conventional pivot mount 58. The pivot mount 58 may be any suitable pivotal mechanical connection that allows the head 34 to rotate in at least one plane relative to the body 40. The pivot mount 58 may be freely rotatable, or may include a friction or mechanical limiting device, such as a ratchet, that holds the mount in a desired relative position yet allows for manual repositioning of the head 34. FIG. 6 depicts a universal type of ball joint 58 that allows the head 34 to have universal movement relative to the body 40. It should be appreciated that any manner of universal or pivotal connection may be utilized between the head 34 and body member 40 within the scope and spirit of the invention.

In the embodiment of FIGS. 2 through 5, the head 34 is mated with the body 40 through a stud or other post member 33. This member 33 may be a separate member from the body 40, or comprise an extension or integral portion of the body 40. The member 33 may serve to space the head 34 away from a larger section of the body 40 to allow for adequate pivotal range of the head 34.

In the embodiment of FIG. 3, the bottom plate 44 has the hook material 38 applied to the top surface thereof. This embodiment may be used without a top plate 42 such that the sheet material 18 would be attached on one side thereof to the plate 44 and pressed by the plate against the ceiling or wall surface of the room 12. It should thus be appreciated that the embodiments utilizing a single clamping surface that engages the nonwoven material on only one side thereof are within the scope and spirit of the invention.

Still referring to FIG. 3, a top plate 42 may be provided that is completely separable from the bottom plate 44, with the clamping surfaces 36 defined by opposed facing surfaces of the separate top and bottom plates. Any manner of releasable locking mechanism 60 may be configured between the separate top and bottom plates. For example, in the illustrated embodiment, a male stud 64 formed on the top plate 42 may be received within a recess 62 defined in the bottom plate 44. The top plate 42 may rotate relative to the bottom plate so that the stud 64 threads into the recess 62. In an alternative embodiment, a friction fit may be defined between the stud 64 and recess 62. The recess 62 should have sufficient dimensions to accommodate the non-woven sheet material 18 placed over the stud 62.

FIG. 6 illustrates a feature of the attachment device 32 that may be useful in locking and positioning the head 34, particularly if a universal joint is configured between the head 34 and body 40. In this embodiment, a sleeve 14 is configured around the body 40, and may have a longitudinal length so as to extend around a portion of the elongated support member 20. This sleeve 14 is longitudinally slidable relative to the body member 40 of the attachment device 32 and has a recess 41 defined at an upper region thereof to accommodate the universal or other pivotal joint 58. In order to lock the head 34 into a position that is generally transverse to the axis of the support member 20, the operator simply releases the lock mechanism 16 and slides the sleeve 14 upwards so that it engages the stud 33 and forces alignment of the stud 33 relative to the body 40. With the joint 58 contained within the recess 41, the lock 16 may be used to lock the sleeve 14 relative to the body 40 or elongated support member 20, resulting in the head 34 being locked into a generally transverse orientation relative to the body 40.

An anti-skid or high friction material 35 may be applied to the upper surface of the head 34 of the attachment device 32, for example to the top surface of the upper place 42. This material 35 may be any conventional material, such as a rubber pad, that prevents the head 34 from slipping relative the wall, ceiling, or other structure against which the head is pressed in the erected state of the system 10.

It may be desired to include a compression or spring feature 50 in any one of the attachment device 32 or elongated support member 20. For example, referring to FIG. 2, a compression device 50 is incorporated within the body 40 of the attachment device 32. The device 50 includes a spring 52 seated against a base 56 within the body 40. The stud 33 of the head 34 includes a plunger 54 that engages the spring 52. This configuration allows the head 34 to be pressed into the body 40 against the force of the spring 52. The compression device 50 allows for initial positioning of the elongated support structure 20 and subsequently functions to press the attachment device 32 against the wall or ceiling structure in the room 12 to ensure that the elongated support members 20 are securely held in position. In the embodiment of FIG. 3, the compression device 50 is configured within the elongated support member 20. In this embodiment, the elongated support member 20 includes a bottom member 24 and a top member 26. The bottom member 24 includes a spring that bears against a base 56. The top member 26 is slidable within the bottom member 24 and includes a plunger 54 that engages against the spring 52. An end of the bottom member 24 is threadedly engaged with the body member 40 of the attachment device 32. Any conventional locking mechanism or device 55 may be utilized to lock, adjust, or release the compression device 50.

Figure 7A:
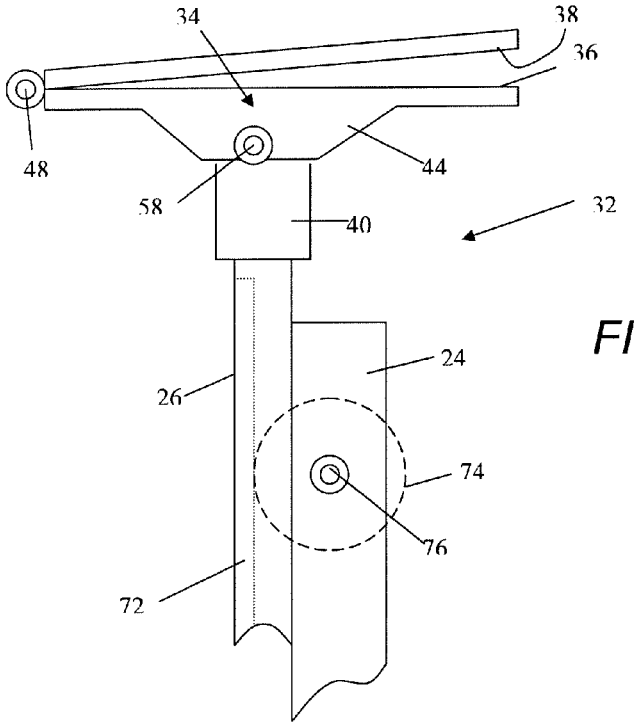
FIG. 7A is a side and partial cut-away view of still another embodiment of an attachment device and support member configuration.
Figure 7B:
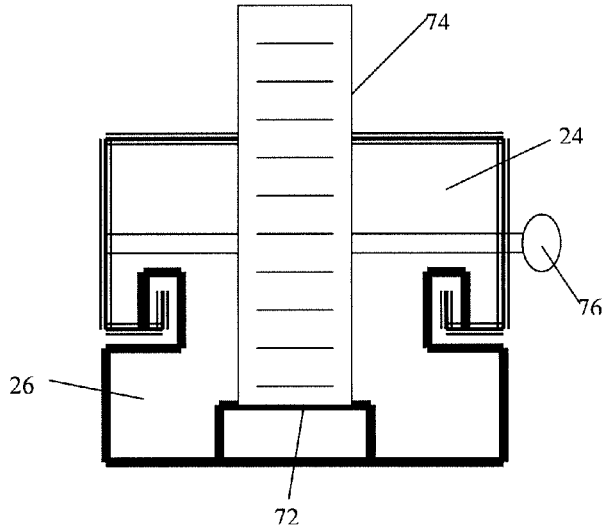
FIG. 7B is a cut-away view of the embodiment of FIG. 7A.

It may be desired to incorporate any manner of length adjustment feature for the elongated support member 20 so that the supports may be used in rooms or enclosures having different ceiling heights, and the like. For example, the elongated support member 30 may comprise a plurality of members that can be attached to each other to vary the overall height of the member 20. These members may be telescoped relative to each other, threadedly engaged, and so forth. FIGS. 7A and 7B illustrate a unique configuration wherein the support member 20 includes a first fixed member 24 and a second adjustable member 26 that slides longitudinally relative to the fixed member 24. The members 24, 26, have an interlocking channel configuration, as illustrated 7B, that allows the member 26 to slide relative to the member 24, but prevents the members from being pulled away from each other. Any suitable interlocking engagement structure may be utilized in this regard. To adjust the height of the member 26 relative to the fixed member 24, a pinion gear 74 engages a rack gear 72 provided along a substantial portion of the length of the movable member 26. The pinion gear 72 may free wheel in an initial operation wherein the operator simply slides the member 26 to a desired position relative to the fixed member 24. The pinion and ratchet gear mechanism also allows for fine-tuning or adjustment of the length of the support member 20 after initial erecting of the support 20 by the operator engaging and turning the exposed portion of the pinion gear 74. To maintain the relative positions of the members, any manner of conventional locking device 76 may be used to prevent rotation of the pinion gear 74. For example, the locking gear 76 may simply be used to tightened or otherwise restrict rotation of the axle of the pinion gear 74. In an alternative embodiment, the locking device 76 may be a ratchet or other similar mechanism that engages the teeth of the pinion gear 74 to permit rotation of the gear in one direction, but prevent rotation in the opposite direction unless the ratchet is released. Any manner of locking device may be utilized in this regard.

While the present subject matter has been described in detail with respect to specific embodiments thereof, it will be appreciated that those skilled in the art, upon attaining an understanding of the foregoing, may readily adapt the present technology for alterations to, variations of, and equivalents to such embodiments. Accordingly, the scope of the present disclosure is by way of example rather than by way of limitation, and the subject disclosure does not preclude inclusion of such modifications, variations, and/or additions to the present subject matter as would be readily apparent to one of ordinary skill in the art.

What is claimed is:

1. A portable partition system, comprising an air permeable nonwoven sheet material;

an elongated support member, and an attachment device having a body configured on a first end of said support member;

said attachment device further comprising a head with opposed separable clamping surfaces having a hook material provided thereon; and wherein said nonwoven sheet material is inserted between said clamping surfaces so as to be engaged directly by said hook material on opposite sides of said sheet material upon erecting said system into a portable partition.

2. The system as in claim 1, wherein said nonwoven sheet material comprises a spunbond/meltblown/spunbond (SMS) material having a basis weight of between about 13 gsm to about 18 gsm.

3. The system as in claim 1, wherein said elongated support member is length adjustable.

4. The system as in claim 3, wherein said elongated support member comprises a compression device configured therein.

5. The system as in claim 1, wherein said attachment device is removably attached to said elongated support member.

6. The system as in claim 5, wherein said attachment device further comprises a compression device configured in said body such that said head is compressible relative to said elongated support member.

7. The system as in claim 1, wherein said head is pivotable relative to an axis of said elongated support member.

8. The system as in claim 7, further comprising a sleeve member configured around said body of said attachment device and slidable to engage and lock said pivotable head in position relative to said elongated support member.

9. The system as in claim 1, wherein said head comprises a bottom plate and a top plate hinged to said bottom plate, said clamping surfaces defined by opposed facing surfaces of said top and bottom plates.

10. The system as in claim 9, wherein said top and bottom plates are spring biased to a closed position.

11. The system as in claim 1, wherein said head comprises a bottom plate and a top plate that is completely separable from said bottom plate, said clamping surfaces defined by opposed facing surfaces of said top and bottom surfaces, and further comprising a releasable locking mechanism configured between said top and bottom plates.

12. The system as in claim 1, wherein said elongated support member comprises telescoping interlocked members and an lockable adjustment mechanism configured between said interlocked members, said attachment device configured on an end of one of said interlocked members.

13. The system as in claim 12, wherein said adjustment mechanism comprises a rack and pinion gear mechanism.

14. The system as in claim 1, wherein said hook material is molded directly into said clamping surfaces.

15. The system as in claim 1, wherein said nonwoven material comprises an electret material.

16. An attachment device for use in a portable partition system, comprising:

a body having an end removably attachable to an elongated support member;

a head configured on said body, said head further comprising opposed separable clamping surfaces having a hook material provided thereon; and wherein said clamping surfaces are configured for receipt of a nonwoven sheet material inserted between said clamping surfaces so as to be engaged directly by said hook material on opposite sides of the sheet material.

17. The device as in claim 16, further comprising a compression device configured in said body such that said head is compressible relative to said body.

18. The device as in claim 17, wherein said head is pivotable relative to said body.

19. The device as in claim 18, further comprising a sleeve member configured around said body and slidable relative to said body to engage and lock said pivotable head in position relative to said body.

20. The device as in claim 16, wherein said head comprises a bottom plate and a top plate hinged to said bottom plate, said clamping surfaces defined by opposed facing surfaces of said top and bottom plates.

21. The device as in claim 20, wherein said top and bottom plates are spring biased to a closed position.

22. The device as in claim 16, wherein said head comprises a bottom plate and a top plate that is completely separable from said bottom plate, said clamping surfaces defined by opposed facing surfaces of said top and bottom plates, and further comprising a releasable locking mechanism configured between said top and bottom plates.

23. The device as in claim 16, wherein said hook material is molded directly into said clamping surfaces.

* * * * *